US008316752B2

(12) United States Patent
Waddell, Jr. et al.

(10) Patent No.: US 8,316,752 B2
(45) Date of Patent: Nov. 27, 2012

(54) ACOUSTIC SHOCK WAVE ATTENUATING ASSEMBLY

(75) Inventors: John L. Waddell, Jr., Houston, TX (US); James F. Gordon, Nokomis, FL (US)

(73) Assignee: Blastgard Technologies, Inc., Clearwater, FL (US)

( * ) Notice: Subject to any disclaimer, the term of this patent is extended or adjusted under 35 U.S.C. 154(b) by 742 days.

(21) Appl. No.: 10/630,897

(22) Filed: Jul. 31, 2003

(65) Prior Publication Data

US 2007/0006723 A1 Jan. 11, 2007

(51) Int. Cl.
*F41H 5/02* (2006.01)

(52) U.S. Cl. ..... 89/36.02; 86/50

(58) Field of Classification Search ..... 89/36.02; 62/457.2, 457.4; 86/50
See application file for complete search history.

(56) References Cited

U.S. PATENT DOCUMENTS

| | | | | | |
|---|---|---|---|---|---|
| 2,602,302 | A | * | 7/1952 | Poux | 62/530 |
| 2,733,177 | A | | 1/1956 | Meyer | |
| 2,738,297 | A | * | 3/1956 | Pfistershammer | 428/117 |
| 2,974,788 | A | | 3/1961 | Robbins | |
| 3,331,322 | A | | 7/1967 | Belanger | |
| 3,360,014 | A | * | 12/1967 | Poisson et al. | 139/389 |
| 3,371,604 | A | | 3/1968 | Per Folke Wikner et al. | |
| 3,491,847 | A | * | 1/1970 | Abbott | 180/271 |
| 3,736,838 | A | * | 6/1973 | Butterweck et al. | 89/36.02 |
| 3,795,994 | A | * | 3/1974 | Ava | 36/29 |
| 3,801,416 | A | * | 4/1974 | Gulbierz | 109/49.5 |
| 4,184,788 | A | * | 1/1980 | Colle | 405/19 |
| 4,251,579 | A | | 2/1981 | Lee et al. | |
| 4,287,250 | A | | 9/1981 | Rudy | |
| 4,299,872 | A | * | 11/1981 | Miguel et al. | 428/117 |
| 4,369,885 | A | | 1/1983 | Redmond | |
| 4,700,706 | A | * | 10/1987 | Munch | 607/96 |
| 4,716,598 | A | * | 1/1988 | Bertram | 2/108 |
| 4,750,318 | A | | 6/1988 | Matsuzawa | |
| 4,836,079 | A | | 6/1989 | Barrett | |
| 4,966,365 | A | * | 10/1990 | Winston | 482/105 |
| 5,076,168 | A | | 12/1991 | Yoshida et al. | |
| 5,110,661 | A | * | 5/1992 | Groves | 428/178 |
| 5,155,959 | A | * | 10/1992 | Richards et al. | 52/455 |
| 5,196,254 | A | | 3/1993 | Akiyama | |
| 5,225,622 | A | | 7/1993 | Gettle et al. | |
| 5,287,961 | A | * | 2/1994 | Herran | 206/219 |
| 5,309,690 | A | * | 5/1994 | Symons | 52/309.9 |
| 5,333,532 | A | | 8/1994 | Smirlock et al. | |
| 5,340,632 | A | | 8/1994 | Chappuis | |

(Continued)

FOREIGN PATENT DOCUMENTS

EP 0276918 A1 8/1988

(Continued)

OTHER PUBLICATIONS

Condensed Chemical Dictionary; Hawley; p. 706; Jan. 6, 1974.*

(Continued)

*Primary Examiner* — Stephen M Johnson

(74) *Attorney, Agent, or Firm* — Browdy and Neimark, P.L.L.C.

(57) ABSTRACT

An assembly for attenuating shock waves is made of two flexible sheets arranged one over the other and joined by a plurality of seams, the flexible sheets being confined to form cells or recessed when joined together. The seams are arranged so as to surround the cells or recesses in the sheets, and the cells or recesses are filled with a shock attenuating material.

12 Claims, 3 Drawing Sheets

U.S. PATENT DOCUMENTS

| | | | | | |
|---|---|---|---|---|---|
| 5,394,786 | A | * | 3/1995 | Gettle et al. | 86/50 |
| 5,534,343 | A | | 7/1996 | Landi et al. | |
| 5,563,364 | A | | 10/1996 | Alhamad | |
| 5,576,511 | A | | 11/1996 | Alhamad | |
| 5,686,689 | A | * | 11/1997 | Snedeker et al. | 89/36.02 |
| 5,738,925 | A | | 4/1998 | Chput | |
| 5,739,458 | A | | 4/1998 | Girard | |
| 5,830,548 | A | * | 11/1998 | Andersen et al. | 428/36.4 |
| 5,849,394 | A | | 12/1998 | Bussey, III et al. | |
| 5,910,540 | A | * | 6/1999 | Takahashi | 525/92 B |
| 5,996,115 | A | | 12/1999 | Mazelsky | |
| 6,279,399 | B1 | | 8/2001 | Holm | |
| 6,289,816 | B1 | | 9/2001 | Keenan et al. | |
| 6,453,477 | B1 | * | 9/2002 | Bainbridge et al. | 2/455 |
| 6,701,529 | B1 | * | 3/2004 | Rhoades et al. | 2/2.5 |
| 6,961,957 | B2 | * | 11/2005 | Carlson | 2/2.5 |
| 7,662,468 | B2 | * | 2/2010 | Bainbridge | 428/304.4 |

FOREIGN PATENT DOCUMENTS

| | | | | |
|---|---|---|---|---|
| EP | 0 312 399 | A1 | * | 4/1989 |
| EP | 1229298 | A1 | | 8/2002 |
| FR | 2 602 038 | A1 | * | 1/1988 |
| FR | 2607241 | A1 | | 5/1988 |
| JP | 63-134300 | U | | 9/1988 |

OTHER PUBLICATIONS

Materials Handbook; Brady; pp. 642-644; Jul. 1, 1959.*
Webster's Unabridged Dictionary; p. 1442; copyright 1996.*
Collins English Dictionary; lone page; copyright 2000.*

* cited by examiner

ACOUSTIC SHOCK WAVE ATTENUATING ASSEMBLY

FIELD OF THE INVENTION

The present invention relates to an improved assembly for attenuating pressure waves in order to mitigate undesirable effects of these waves.

BACKGROUND OF THE INVENTION

Explosive devices are increasingly being used in asymmetric warfare to cause destruction of property and loss of life, particularly in urban areas or against transportation facilities. These explosive devices can sometimes be disrupted but there often is not sufficient warning of an attack. This is becoming more so in a global scenario of suicide attacks and maximized mass casualties.

Explosive devices produce blast fragments emanating both from the device casing and from material close to the point of explosion, so called secondary fragmentation. In addition explosive devices produce shock waves, which can be characterized by having a rise time that is a virtual discontinuity in the physical properties of the gas through which it propagates. It is possible that acoustic waves may ramp up to form shock waves as higher pressure waves travel with a higher velocity than low pressure waves. However, for an explosive device the waves produced are always shock waves. Shock waves produce the highly damaging phenomenon known as blast. Shock waves travel at a speed related to their amplitude, higher pressures traveling faster than lower pressures, and the characteristics of a given medium. Once produced, the shock wave propagates outward from the source of the explosion obeying certain physical laws. These laws, the conservation of mass, momentum and energy, describe how the shock propagates through a medium and, importantly, how it propagates from medium to medium with the associated changes in velocity and pressure. Shocks propagating away from the source of the explosion will generally be expected to drop in pressure very rapidly. This is highly dependent on the area surrounding the explosion. Reflective barriers, tunnels, corners and many other structural features can reduce the rate at which the shockwave decays and, in some circumstances, locally increase pressures.

A shock propagating radially decays rapidly with distance as the energy is shared over an increasing surface area. Shocks travelling in a planar motion, such as in a tunnel, decay at significantly lower levels as they lose energy only at the edges where the wall and shock interface. This rate of pressure decay can be dramatically increased by placing material in the path of the shock. Materials that possess elements of differing shock impedance, the presence of phase boundaries and the ability to absorb energy by work done on producing irreversible changes within the material, are excellent shock pressure attenuators. Porous solid materials possess these qualities and are excellent attenuators of shock waves and therefore of blast. Gases and solid crystalline materials are inherently poor pressure wave attenuators.

Pressure waves can be reflected and diffracted by phase boundaries, such as liquid droplets or solid particulates suspended in air. These deflections serve to increase the distance that the wave travels by a process of multiple reflections and diffractions. Scattering and dispersion thus produce more attenuation because they smear the discontinuity leading the shock wave, the result of which is a significant drop in pressure in the material. This process has been shown to only provide a low level of attenuation over all, as the resultant acoustic wave emerging from the medium can ramp up again into a shock wave. Energy expended in accelerating the mass and in irreversible changes in the material, i.e., crushing, accounts for the majority of the attenuation. These mechanisms significantly reduce, or altogether eliminate, the pressure waves originally traveling in a specific direction.

Rebut, in French patent 2 573 511 discloses a partition or wall having high thermal and mechanical resistance comprising honeycombs into which are introduced compressible element(s) or which will impart properties of extensibility, inflammability, rigidity, or resistance to mechanical or thermal shocks. Examples of filler materials include aramide or compressible materials, or elastic materials. Other materials include foamed rubber, polyester, incombustible materials (for inflammability protection), which may include incombustible foamed rubber along with aramide or metallic materials. Mixtures of carbon/aramide can protect from about 600-700° C. Mixtures of carbon and ceramic protect up to about 2500° C., and ceramic alone protects up to about 3500° C. For rigidity, the cells may be filled with boron, carborundum, silica, etc.

Mazelsky, in U.S. Pat. No. 5,996,115, discloses flexible body armor made of a single layer of ceramic tiles adhesively attached to a flexible fragment-trapping jacket.

Gulbierz, in U.S. Pat. No. 3,801,416, discloses a flexible blast fragment blanket made of a plurality of layers of flexible blast-resistant material with blast-resistant plates embedded therein. Channels are located between the plates to impart flexibility to the blanket Keenan et al., U.S. Pat. No. 6,289,816, discloses a water blanket for resting on pallets of ordnance to mitigate gas pressure loading from an inadvertent explosion of the ordnance. The blanket includes a pair of storage modules, and each module comprises a plurality of water storage compartments for water.

Gettle, in U.S. Pat. Nos. 5,225,622 and 5,394,786, discloses materials described as a flowable attenuating medium exhibiting aqueous foam characteristics which comprises solid particulate having bulk mechanical properties and flow properties of a fluid. These materials are produced as panels that are relatively rigid.

The most effective materials in attenuating acoustic waves and shocks are produced in flat panels. Most attenuating panels have, for ease of manufacture, been made as flat panels. When it is required to protect objects that are not flat, such as garbage receptacles and containers, flat panels do not provide adequate protection for non-flat surfaces, and the rigid material is not capable of being bent to conform to a curved surface. In many applications a blast attenuating material may be required for use outside. The material must be such that it is not affected by environmental conditions, such as water, snow, sleet, and other unfavorable conditions.

SUMMARY OF THE INVENTION

It is an object of the present invention to avoid the aforementioned deficiencies of the prior art.

It is another object of the present invention to provide materials for attenuating the effects of explosions or blasts that can be used for a variety of configurations and which are sufficiently flexible so that the material can be placed around any shape container or surface.

It is yet another object of the present invention to provide a blast mitigation assembly that can be wrapped around or that can conform to any shape surface.

It is a further object of the present invention to provide a blast mitigation assembly that can be cut to substantially any desired size without compromising the blast attenuating ability of the assembly.

The assembly of the present invention provides shock wave, and therefore blast, attenuation capabilities in both confined spaces and unconfined areas. The assembly of the present invention comprises two flexible sheets arranged one over the other and joined by a plurality of seams. The seams may be welded, stitched, hot melted together, or joined in any conventional way. The seams are arranged so as to form cells or recesses in the shells, and the cell or recesses are filled with a shock absorbing material. The assembly can be cut to the desired size along any of the seams without loss of the shock attenuating material.

The assembly of the present invention is highly efficient at rapidly attenuating high pressure shock waves, i.e., blast. The assembly of the present invention provides shock wave attenuation in confined spaces without requiring the space to be completely filled by aqueous foam or any other agent or medium. The assembly provides attenuation of shock waves for both proximate and remote explosions. The assembly provides shock wave attenuation in confined spaces without the need for the confining walls to be gas-tight, or free from leaks or penetrations.

The pressure wave attenuation assembly of the present invention is flexible and can be wrapped around any shape to conform to the shape of the wrapped item. Because the specific acoustic wave attenuating material is confined within the recesses in the assembly, the assembly can be cut at any area between the recesses so that the attenuation material does not leak out.

The attenuation material of the present invention may include materials for providing additional capabilities, such as adding insulation to protect a system from fire or some types of radiation, including $\alpha$, $\beta$ and $\gamma$ rays and X rays, intumescent orgopolymer coatings to provide additional thermal energy resistance from proximate explosions or post-blast fires, or to include chemical fire-suppressing powder or gaseous agents within. These additional materials are well known in the are of insulating and fireproofing.

According to the present invention, a blast mitigation assembly is provided in the form of a flexible laminate or assembly formed of a first layer of a flexible material and a second layer of flexible material having pockets or recesses formed therein, the pockets or recesses being filled with a material that absorbs or attenuates the shock of a blast. The assembly of the present invention attenuates all types of pressure wave, both acoustic or shock waves, in all gaseous environments, particularly in ambient atmospheric conditions. More specifically, the assembly of the present invention substantially suppresses or attenuates blast effects from either proximate or remote explosions as one of the more severe examples of pressure wave, acoustic, or shock wave conditions.

Of particular importance is the fact that the assembly of the present invention is flexible and can be used to surround any configuration. This is particularly important in protecting structures that require other than flat panels, for structures that are not rectangular or cubical in shape, such as trash receptacles, mailboxes, and the like.

Thus, the present invention comprises placing shock-attenuating material in separate compartments that are connected together as part of a flexible sheet. The flexible sheet can be cut anywhere between the compartments to form a flexible sheet of the desired dimensions, and none of the shock attenuating material is lost when the sheet is cut.

The shock attenuating material of the present invention is preferably a flowable medium which impedes shocks. Materials that possess elements of differing shock impedance, the presence of phase boundaries and the ability to absorb energy by work done on producing irreversible changes within the material are confined within individual cells or recesses in a flexible sheet. The flexible sheet which confines the shock attenuating material is sufficiently porous with respect to the acoustic or shock wave to allow the acoustic or shock wave to penetrate the flowable attenuating medium. Porosity of the materials used allows the shock wave to pass rapidly into the material, absorbing energy from the shock wave. This creates turbulent zones and large numbers of miniature shock waves as energy from the shock wave passes into and through the flowable attenuating medium. The porous material is arranged on both sides of the cells or recesses providing excellent shock attenuation independent of the direction of the shock wave. Substantial energy from the shock wave is absorbed by the attenuating medium, enhanced by confinement within the cells or recesses.

Preferably, the flowable attenuating material is perlite, which is known to have substantial energy absorbing capabilities. However, the flowable attenuating material may also be formed, for example, from solid particulate material preferably having bulk mechanical properties and flow properties of a fluid. Because the solid particles are contained within recesses or cells, there is little relative displacement of the particles within the material as a whole.

For purposes of the present invention, the term "mechanical properties and flow properties of a fluid" refers to the ability of the attenuating medium to act in the nature of a liquid mass to resist relative displacement by surface tension and viscous forces, and the ability to substantially scatter and disperse pressure conditions transmitting therethrough by virtue of multitudinous curved surfaces dividing gaseous and solid or liquid and solid phases, and enabling the generation of turbulent flow fields by transmitting pressure conditions. More briefly, these terms may be taken as referring to the ability to resist applied shear forces in the nature of fluid viscosity. The attenuating medium assumes the shape of the cells or recesses, while at the same time resisting applied shear forces in the nature of viscosity.

The cells or recesses in the flexible sheets can be of any shape, with spherical being the most efficient.

Another use of the shock attenuating assembly of the present invention is to place the material between a structure and a surrounding liquid medium such as seawater for protecting the structure from shock waves of other pressure wave phenomena arising from underwater explosions or seismic activity. In this case the flexible material should be water-impermeable, or a water-impermeable covering can be placed over the flexible material. In this case the flowable attenuating medium is preferably Perlite.

In another embodiment, the attenuating medium can be formed by solid particles which may be hollow or may otherwise include a gaseous phase, the particles preferably being macroscopic and even more preferably having a diameter of about one millimeter.

In yet another embodiment of the present invention, the attenuating medium is in the form of an aerogel, a very light weight material described in greater detail below.

Additional objects and advantages of the present invention are to provide total reliability and effectiveness by using no moving or electrical components, and by not depending upon materials which must be without flaws, imperfections, or other defects. The material of the present invention can use any type of available materials which function to attenuate shock waves and which can enclose the attenuating material in cells or recesses. The material of the present invention provides substantial attenuation of all types of pressure waves on the source sides as well as the remote side of the pressure wave attenuating structure.

BRIEF DESCRIPTION OF THE

DETAILED DESCRIPTION OF THE INVENTION

Figure 1:
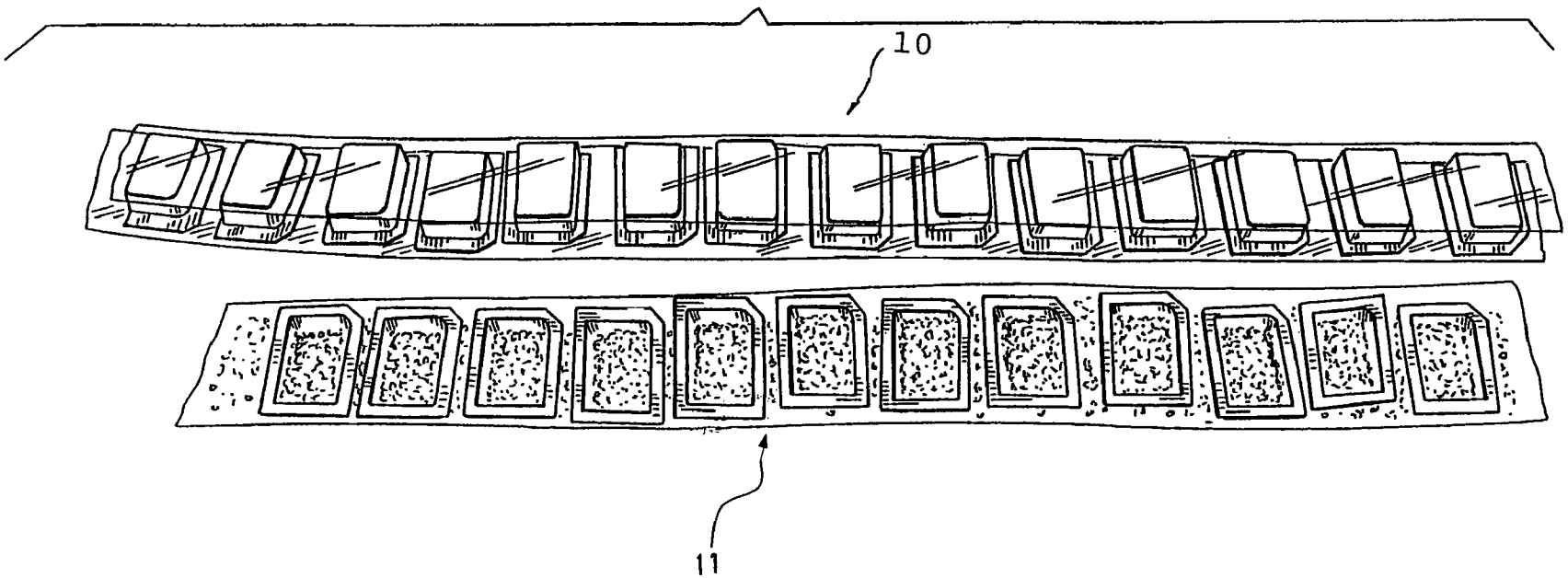
FIG. 1 shows tops and bottoms of the assembly prior to being assembled.

FIG. 1 shows tops 10 and bottoms 11 of the attenuating assembly prior to assembly. Once these cells of attenuating material are joined together as by adhesive means to form seams, the assembly can be cut at the seams to the desired dimensions.

Figure 2:
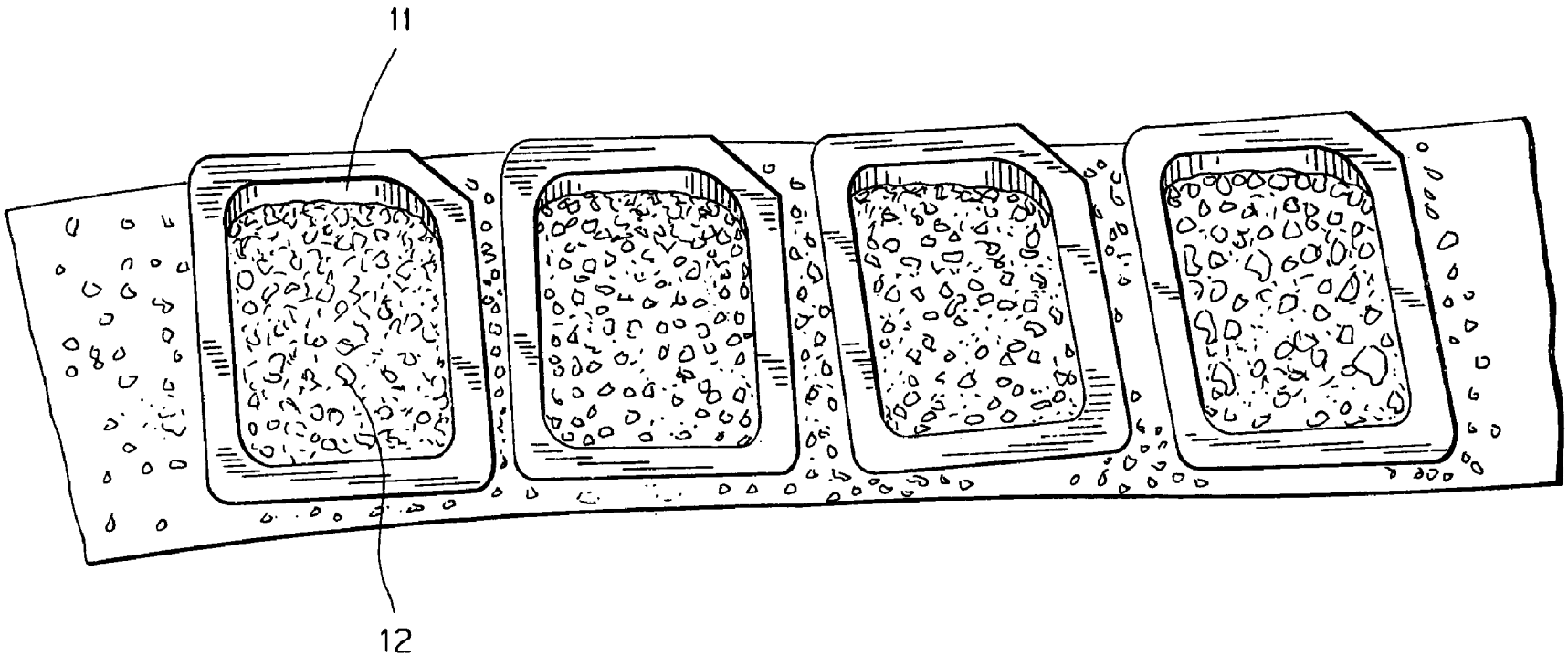
FIG. 2 is a close up view of the bottoms of the assembly.

FIG. 2 shows a closer view of the bottoms 11 of the assembly. In this case the cells are filled with perlite as blast mitigating material 12.

Figure 3:
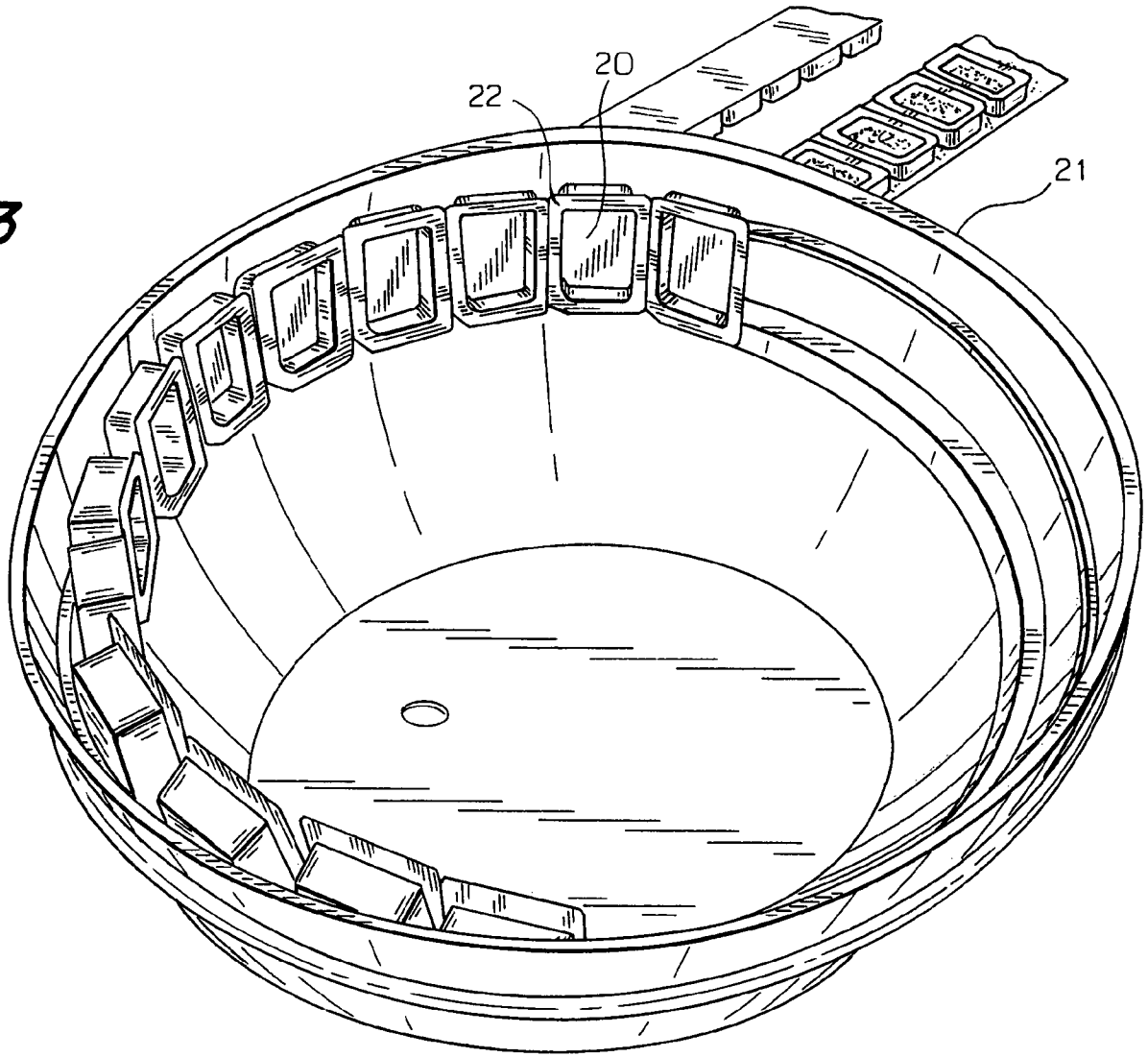
FIG. 3 shows the assembly installed inside a round container.

FIG. 3 shows the assembly 20 installed in the interior of a dish 21, illustrating how the assembly can assume the shape of the surface it is to protect. The individual cells are joined at the seams 22, and the assembly can be cut at any of the seams to form a desired shape or size.

While the assembly has been illustrated with rectangular cells for retaining the shock attenuating material in place, the cells can be of any desired shape, including round, oval square, rectangular, polygonal, etc. The size of the cells is not critical other than to make them sufficiently small that the assembly can be cut to the desired size and shape, and can be used to conform to the shape of the object to be protected. The cells can be, for example, from about 1 to about 4 inches wide and from about 1 to about 5 inches thick, depending upon the ultimate use of the assembly.

In one method of producing the assembly, a flexible panel is provided with recessed cups. The cups are filled with attenuating material and a frangible cover is placed over the panel. This frangible cover is attached to the flexible panel by seams around each of the cups, making it possible to cut the assembly without the shock attenuating material leaking from the cups.

The assembly can be made of any material that can be configured to form cups to hold the shock attenuating material. However, it is preferred to use a flexible waterproof plastic resin, which makes it possible to bend the assembly to the desired configuration.

The pressure wave attenuating material that is placed into the cells or recesses of the laminate may be an aqueous foam, a gas emulsion (wherein a gas is entrained and dispersed through a liquid matrix in the form of bubbles, with the gas bubble diameters generally commensurate with the thickness of the liquid bubble walls), a gel (preferably with entrained gas), or granular or other solid particles which have the necessary flow characteristics. The preferred pressure wave attenuating material is Perlite.

When aqueous foams are used as the flowable attenuating medium, they may be generated from any foamable agents, preferably those which are normally used in fire suppression, which then imparts some fire resistance to the material. These agents include hydrolyzed protein liquids, proteinaceous liquids with fluoropolymeric additives, along with a large number of synthetic surfactant and stabilizing chemical combinations. The foaming gas for use in the gas source may be of a similarly wide range, so long as the gas is not chemically reactive in a destructive manner with the stabilizing components in the bubble wall liquids. Foaming gases preferably include inert gases such as argon, or fire extinguishing gases such as carbon dioxide, sulfur hexafluoride, or halogenated carbon compounds (halons). Compressed air is also an acceptable foaming gas.

Solid particles for use as the shock attenuating medium preferably have both mechanical properties and flow properties of a fluid. Also preferably, the solid particles include means for resisting relative displacement of the particulates in order to better simulate characteristics of an aqueous foam. For such a purpose, the particles may be provided with a coating to resist relative motion between the particles while permitting flow in accordance with the present invention. For example, the coating may be a light adhesive or may even comprise hook and loop fasteners for resisting relative movement between the particles.

The solid particles may be of any shape, including spherical and irregular forms. The largest diameters or largest cross sectional dimensions of the particles used in the present invention should generally be less than half the depth or diameter of the cells or recesses. The solid particles should generally be macroscopic. These particles may be hollow with solid surfaces, solid shells with internal cavities containing liquid phases, or may be comprised entirely of solid material. The solid material may be a solid foam, such as a polyurethane or other elastomeric compound, or otherwise be a sponge, wherein the gas and solid phases are both continuous, which thus distinguishes sponges from foams, in which the gaseous phase is entire enclosed within a liquid or solid continuous phase. Alternatively, the solid particles may be comprised of entrapped gas phases, for example, in the nature of volcanic foam glasses, perlite, vermiculite, pumice, or the like. The preferred solid particles are perlite.

Any of the solid particles used in the present invention can be flexible or elastic or rigid.

When aqueous foams are used as the pressure attenuating material, substantial energy is removed from an incident pressure wave by scattering at the multiple interfaces presented by bubble wall liquids and the entrapped gas which comprise the basic units of aqueous foam structures, and through the displacement of the liquid in the aqueous foam. A similar effect is obtained when solid bead materials are employed-particularly solids with entrained gas, such as vermiculite and organic solid foams. In the case of aqueous foams, substantial energy is also removed from pressure waves reflected back into the attenuating fluid from the flexible film covering due to turbulent flow fields established by passage of the initial pressure wave. This is impossible for solid foam materials.

Additional energy and thus attenuation of transmitting pressure waves is accomplished by cancellation (this cancellation occurs only at certain points as dictated by superposition. The wave reasserts itself after that position. The decay of the wave is related to the work done as it travels through the media and for how long it remains in the media. Perlite and foam shock absorbing materials dramatically reduce the sound speed of the shock, around 150 m/s with regards to the shock absorbing materials as scattered, slowed, and reflected waves become coincident. A further contributor toward energy removal by the invention is that propagation paths of pressure waves through the shock absorbing materials are substantially lengthened by their scattering and dispersion. All of the energy possessed in that discontinuity is dispersed by the numerous interfaces. At each interface there are different materials with different shock impedances where some of the shock is transmitted and some reflected. This takes energy away from the discontinuity and disperses it within the attenuating material. This in itself is not enough to dramatically reduce the shock, as on exitting the media the pressure wave will "ramp up" to a shock again with little losses. What is needed is a substantially irreversible mechanism to absorb energy, crushing Perlite, or bursting bubbles, for example. The dominant mechanism is the rapid acceleration of the material by the shock and then rapid deceleration by the surrounding media.

Incident shock waves are attenuated by additional phenomena generated by the assembly of the invention. Shock and blast waves consist of an initial overpressure, or positive pressure phase (in excess of the ambient initial pressure) followed by a negative, or rarefaction, phase. The rarefaction phase is typically longer in duration unless the shock waver undergoes reflections.

Shock waves displace bubbles and accelerate liquids in bubble walls of an aqueous foam, causing the bubbles to shrink and many bubbles to collapse. This displacement of the liquid, the breaking of bubble walls against the cohesive force of their surface tension, and the acceleration of liquid droplets formed from shattered bubble walls all absorb substantial energy from the transmitting shock wave. Substantial parts of the transmitting shock wave are reflected back into the aqueous foam at the interface between the foam and contiguous gas or solid, a process which is repeated numerous times by part of the original incident pressure wave, in essence trapping part of the original incident pressure wave.

Yet another substantial contributor to energy removal from the incident shock wave, thus attenuating these waves, is that the incident wave within the pockets of the assembly reflects a portion of the incident shock wave. In this manner, only a fraction of the energy carried by the incident shock wave is allowed to pass through the first screen encountered. Where the transmitted shock encounters another screen, another fraction of this shock wave is reflected back. When the transmitted shock encounters another screen, another fraction of this shock wave is reflected back. When the reflected wave must travel through perlite particles or aqueous foam dispersion, attenuation of the wave is greatly increased through the phenomena described above.

In another embodiment of the present invention, two layers of flexible material are used. One layer contains the shock attenuating material enclosed within cells or recesses, while the second layer comprises flexible material from which air has been removed from the cells or recesses. This combination greatly increases pressure wave attenuation because evacuated or vacuum spaces will not transmit pressure waves. Incident pressure waves will reflect at the solid surface which confines the vacuum unless the waves are sufficiently intense as to rupture the confining surface. Once the confining surface is ruptured, the pressure wave is transmitted by the flowable attenuating medium accelerated through the rupture, and the ambient gas is able to leak into the formerly evacuated space. However, only a small portion of the incident pressure wave would be conveyed in this manner because of the small mass and irregular structure of the accelerated, unconfined flowable attenuating medium. Further reflection and scattering of the transmitted pressure wave occurs upon encountering successive layers of the material.

The flexible laminates of the present invention can be coated with compounds that absorb thermal and radiant energy. These types of chemicals reduce the energy of incident blast waves due to the mathematical linkage between blast wave temperature, overpressure, and propagation velocity, which enhances attenuation of the incidental blast wave. Thermal energy absorbing materials only serve to enhance attenuation capabilities in certain applications, however.

The pressure wave attenuating assembly of the present invention can be used for any type of pressure wave transmitted in a fluid medium. Other energy absorbing or protective features can easily be added to enhance the attenuating capabilities of the material, or to provide additional capabilities, such as stopping fragments resulting from explosions. Typical agents commonly used in fighting fires can be used in the present invention.

The attenuation of acoustic waves is accomplished without regard to intensity, directionality, or frequency. The material operates regardless of orientation with respect to impinging pressure waves or, where present, confining walls defining an enclosure in which the invention is placed. The assembly of the present invention is light in weight and thus is easily portable in sizes which are useful for noise suppression around aircraft with jet or gas turbine engines. When protected from heat and light, aqueous foams are stable for prolonged periods.

Simultaneous attenuation of all types of pressure waves makes it possible to dispose of explosives and ordnance near structures or inhabited areas. By mitigating blast energy, noise and shock waves are attenuated. Bomb fragments are stopped by a combination of reducing kinetic energy and by multiple layers of optional high strength material. These same capabilities enable these devices to be used to provide protection of artillery crews exposed to enemy artillery and air dropped munitions from both blast effect and from the noise produced by their own guns. The flexibility of the material of the present invention makes it possible to form the material into a variety of shapes, allowing for better protection of structures.

The flexibility of the assembly of the present invention makes it useful for protecting ships and offshore structures from shock effects arising from underwater explosions when Perlite or aqueous foams are used as the flowable attenuating medium. The flexibility of the assembly makes it possible to protect the entire hull of a ship, or all of an underwater structure. The assembly of the present invention can similarly be used for protecting offshore and coastal structures from seismic shock effects, which is particularly important for underwater sensing devices.

The preferred shock attenuating agents are paticles of Perlite which are not toxic and which do not produce toxic compounds when in use. The assembly is light in weight and may easily be stowed during transport or when not needed. Unlike explosion vents, however, the assembly of the present invention can be used in closed spaces. This latter feature is critical aboard ships, which cannot be opened to the sea, and within any structure in which smoke and combustion products must be confined to avoid harm to trapped individuals and to facilitate emergency crew operations.

The attenuating material may also be an aerogel, which includes a plurality of small cavities filled with a gaseous phase. Aerogels can be manufactured with extremely low densities, almost down to that of atmospheric air at sea level, and have long been known to those skilled in the art of low density materials.

Another alternative for the attenuating material is an aqueous foam, as described above. Like Perlite, these foams are not toxic and do not produce toxic compounds when in use.

In another embodiment of the invention, the assembly can be used as an exterior armor or barrier element for a wide variety of structures. Since the assembly is flexible, it can easily be made to conform to the shape of the structure produced.

It is also possible to wrap an explosive device in the assembly of the present invention to protect it from other explosive devices in the vicinity thereof. The flexibility of the assembly means that it can be made to conform to any shape desired for maximum protection from shock waves. Alternatively, the assembly can be used to line a container; the container can be of any shape, because of the flexibility of the assembly.

The foregoing description of the specific embodiments will so fully reveal the general nature of the invention that others can, by applying current knowledge, readily modify and/or adapt for various application such specific embodiments without undue experimentation and without departing from the generic concept. Therefore, such adaptations and modifications should and are intended to be comprehended within the meaning and range of equivalents of the disclosed embodiments. Is this English It is to be understood that the phraseology or terminology employed herein is for the purpose of description and not of limitation. The means and materials for carrying out various disclosed functions may take a variety of alternative forms without departing from the invention.

Thus, the expressions "means to . . . " and "means for . . . " as may be found in the specification above and/or in the claims below, followed by a functional statement, are intended to define and cover whatever structural, physical, chemical, or electrical element or structures which may now or in the future exist for carrying out the recited function, whether or nor precisely equivalent to the embodiment or embodiments disclosed in the specification above. It is intended that such expressions be given their broadest interpretation.

What is claimed is:

1. A shock-attenuating assembly that is sufficiently flexible to wrap around any shaped structure, said assembly comprising, in combination, (a) a first film of flexible resin material, wherein said first film of flexible resin material is optionally water-impermeable or is optionally coated with a water-impermeable material;

(b) a second film of flexible resin material, wherein said second film of flexible resin material is optionally water-impermeable or is optionally coated with a water-impermeable material, wherein said second film of flexible resin material has attached pockets spaced from each other along the second film;

(c) the first film is attached to the second film via a plurality of seams, wherein the seams surround each of the spaced pockets in such a manner as to make the assembly sufficiently flexible to surround a structure of any shape;

(d) each of the pockets is filled with a flowable shock wave attenuating material selected from the group consisting of volcanic foam glasses, perlite, vermiculite and pumice; and (e) wherein both the first film and the second film are sufficiently porous with respect to acoustic or shock waves or gas to allow the acoustic or shock wave to penetrate the film to reach the flowable shock wave attenuating material.

2. The flexible shock-attenuating assembly according to claim 1 wherein the shock attenuating material is perlite.

3. The flexible shock-attenuating assembly according to claim 1 further including within the pockets at least one material selected from the group consisting of fireproofing materials, heat insulating materials, intumescent materials, and radiating insulating materials.

4. The flexible shock-attenuating assembly according to claim 1 further including within the pockets a fire retarding material.

5. The flexible shock-attenuating assembly according to claim 1 wherein the assembly is adapted and constructed so that the assembly can be cut along the seams so that shock attenuating material remains confined in the pockets.

6. The flexible shock-attenuating assembly according to claim 1 wherein the flexible sheets are water-impermeable.

7. A carrier for shock-attenuating material, which carrier is sufficiently flexible to wrap around a structure of any shape structure, said carrier and shock attenuating material comprising, in combination, (a) a first film of flexible resin material, wherein said first film of flexible resin material is optionally water-impermeable or is optionally coated with a water-impermeable material;

(b) a second film of flexible resin material, wherein said second film of flexible resin material is optionally water-impermeable or is optionally coated with a water-impermeable material, wherein said second film of flexible resin material has attached pockets spaced from each other along the second film;

(c) the first film is attached to the second film via a plurality of seams, wherein the seams surround each of the spaced pockets in such a manner as to make the carrier sufficiently flexible to surround any shaped structure;

(d) each of the pockets is filled with a shock wave attenuating material selected from the group consisting of volcanic foam glasses, perlite, vermiculite, and pumice; and (e) wherein both the first film and the second film are sufficiently porous with respect to acoustic or shock waves to allow the acoustic or shock wave to penetrate the film to reach the flowable shock wave attenuating material.

8. The carrier according to claim 7 wherein the shock wave attenuating material is perlite.

9. The carrier according to claim 7 further including within the pockets at least one material selected from the group consisting of fireproofing materials, heat insulating materials, intumescent materials, and radiating insulating materials.

10. The carrier according to claim 7 further including within the pockets a fire retarding material.

11. The carrier according to claim 7 wherein the carrier is adapted and constructed so that the carrier can be cut along the seams so that shock attenuating material remains confined in the pockets.

12. The carrier according to claim 7 wherein the flexible sheets are water-impermeable.

* * * * *